US007312176B2

(12) United States Patent
Hamada et al.

(10) Patent No.: US 7,312,176 B2
(45) Date of Patent: Dec. 25, 2007

(54) THERMALLY SENSITIVE RECORDING MEDIUM

(75) Inventors: Kaoru Hamada, Tokyo (JP); Kenji Hirai, Tokyo (JP); Takanori Otsuhata, Tokyo (JP); Takashi Date, Tokyo (JP); Junpei Natsui, Tokyo (JP); Yoshihide Kimura, Tokyo (JP); Aya Katoh, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 169 days.

(21) Appl. No.: 10/532,389

(22) PCT Filed: Oct. 24, 2003

(86) PCT No.: PCT/JP03/13655

§ 371 (c)(1),
(2), (4) Date: Sep. 23, 2005

(87) PCT Pub. No.: WO2004/050381

PCT Pub. Date: Jun. 17, 2004

(65) Prior Publication Data

US 2006/0125909 A1 Jun. 15, 2006

(30) Foreign Application Priority Data

Oct. 24, 2002 (JP) ..... 2002-310213

(51) Int. Cl.
*B41M 5/30* (2006.01)

(52) U.S. Cl. ..... 503/209; 503/209

(58) Field of Classification Search ..... None
See application file for complete search history.

(56) References Cited

FOREIGN PATENT DOCUMENTS

EP 1 375 182 A1 * 1/2004
JP 61-043593 * 3/1986
WO WO 02/081229 A1 * 10/2002

* cited by examiner

*Primary Examiner*—Bruce H. Hess
(74) *Attorney, Agent, or Firm*—Flynn, Thiel, Boutell & Tanis, P.C.

(57) ABSTRACT

A thermally sensitive recording medium including on a support a thermally sensitive color development layer containing: a compound represented by the following general formula (1) as an organic color developing agent; and an oxalate compound represented by the following general formula (2) as a sensitizer.

(1)

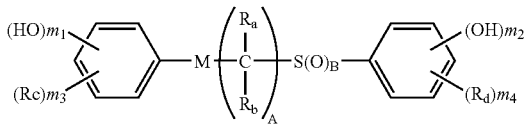

(2)

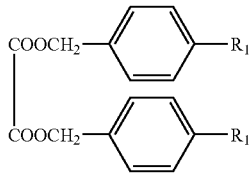

(In the formula (1): M represents CO or NRCO; when M is CO, $m_1$ is 1; and when $m_1$ is 0 and M is NRCO, B is not 0.)

6 Claims, No Drawings

THERMALLY SENSITIVE RECORDING MEDIUM

FIELD OF THE INVENTION

The present invention relates to a thermally sensitive recording medium utilizing a color reaction of a basic colorless dye and an organic color developing agent and, more specifically, to a thermally sensitive recording medium having excellent inkjet recordability on a back surface thereof.

BACKGROUND OF THE INVENTION

In general, a thermally sensitive recording medium having a thermally sensitive recording layer that contains as main components a colorless or pale colored dye precursor and a color developing agent reacting with the dye precursor under heating to develop color is put into practical use extensively. A thermal printer incorporated with a thermal head or the like is used for recording on the thermally sensitive recording medium. Such a thermally sensitive recording method has features in that the method produces no noise during recording, requires no developing or fixing, is maintenance-free, employs relatively inexpensive and compact instruments, and provides very clear color development, compared with other conventional recording methods in practical use. Thus, the thermally sensitive recording method is used extensively in a facsimile or computer field, for various measuring instruments and labels, and the like with the development of the information industry.

Required qualities for the thermally sensitive recording medium have increased to a higher level with the progress in diversification of recording devices and in the production of high performance recording devices. Regarding color development sensitivity, a high density image having a clear color development has been demanded even with a very small thermal energy with the progress in miniaturization of devices and speeding up of recording. In order to satisfy the demand, Patent Document 1 describes a method of enhancing the color development sensitivity by using a novel color developing agent, for example.

Patent Document 1 JP-A 2002-301873

Storage stability of a color image to a natural environment such as heat, water, humidity, or light, to body fat from handling of the color image by hand, to oil, a plasticizer, a solvent, or the like, and favorable background color are demanded for the thermally sensitive recording medium with an expansion of its application. Of the required qualities, it is particularly difficult to provide the thermally sensitive recording medium with an image stability to light. Moreover, a high color development sensitivity and a high thermal resistance are opposite characteristics, and it is very difficult to attain both characteristics.

Various improvements have been made on the resistance of a color image, and color images that withstand use under long-term storage or harsh storage conditions (stability with time, temperature and humidity resistance, water resistance, chemical resistance, or friction resistance, for example) have been put into practical use. As a result, the use of the recording medium is not simply limited to the field of information recording. A colored image having an improved resistance allows information storage, and the recording medium itself has also been used as a note.

When the thermally sensitive recording medium as described above is used as a note, the recording medium is often brought into contact with oil of a human hand, a plasticizer for synthetic leather used in wallets, and the like, to thereby cause a disadvantage in that a color image fades significantly. Further, a color image must be clear, even after long-term storage, and favorable thermal response and storage stability of the color image are desired. However, it is particularly difficult to provide the conventional thermally sensitive recording medium with an image stability to light. No thermally sensitive recording medium with a sufficient quality and having a good balance among color development sensitivity, image storage stability and the like has been obtained.

When a thermally sensitive recording medium is applied to uses as notes such as tickets, voting cards, bonds, and receipts, an input of much information is desired and easy confirmation of authenticity of issued notes is demanded. In a case of a lottery ticket for a lottery or the like, variable information such as a serial number is printed on the ticket in advance during a ticket processing step for preventing falsification or alteration thereof. An inkjet method has recently spread as means of printing such information, and a thermally sensitive recording medium having inkjet recordability has been strongly desired. Patent Documents 2 and 3 each describe a thermally sensitive recording medium having inkjet recordability on a back surface thereof.

Patent Document 2 JP-A 2000-203163

Patent Document 3 JP-A 2000-318319

However, those are essentially thermally sensitive recording media and may be exposed to rain outside or used under a high humidity and are apt to cause problems such as a bleeding phenomenon of an ink image (feathering), a small ink optical density, and flowing out of the ink when the image gets wet with water. Thus, water resistance for withstanding the problems is demanded for the thermally sensitive recording medium. Recording media used in the inkjet recording method are roughly classified into a plain paper type having a texture similar to that of so-called good quality paper/electrophotographic paper (PPC paper), and a coated paper type having an inkjet recording layer (ink receiving layer). In particular, an inkjet recording medium of a plain paper type has a fiber on a paper surface exposed, so feathering is apt to occur. Regarding inkjet recordability, high color developing ability, ink-absorbing ability, color reproducibility, and the like are required, and full color recording requires higher ink-absorbing ability, in particular.

Meanwhile, the inkjet recording medium may have offset printability on a surface and inkjet recordability on a back surface for uses as postcards or the like. For example, Patent Document 4 describes a multi-layered sheet of three or more layers having an oil-absorbing filler with an oil absorption of 80 ml/100 g or more on a back layer serving as an inkjet recording surface.

Patent Document 4 JP-A 9-143900

DISCLOSURE OF THE INVENTION

As a result of extensive studies by the inventors of the present invention, an object of the present invention was attained with a thermally sensitive recording medium provided with a thermally sensitive recording layer containing, as main components, a colorless or pale colored basic colorless dye and a specific organic color developing agent, and further containing a specific stabilizer and/or a specific sensitizer.

That is, the gist of the present invention is attained with a thermally sensitive recording medium comprising a thermally sensitive recording layer containing a colorless or pale colored basic colorless dye and an organic color developing agent as main components on a support, wherein the thermally sensitive recording medium contains;

a compound represented by the following general formula (1) as the organic color developing agent, (1)

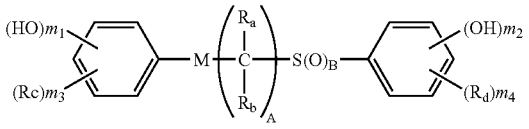

in the formula, Ra and Rb each independently represent a hydrogen atom or an alkyl group having 1 to 6 carbon atoms, A represents an integer of 1 to 6; B represents 0, 1, or 2, $m_1$ and $m_2$ each independently represent 0 or an integer of 1 to 3, but $m_1$ and $m_2$ are not both 0, $R_d$, and $R_d$ each independently represent a nitro group, a carboxyl group, a halogen atom, an alkyl group having 1 to 6 carbon atoms, or an alkenyl group having 2 to 6 carbon atoms, $m_3$ and $m_4$ each independently represent 0 or an integer of 1 or 2, when $m_3$ and $m_4$ are both 2, $R_c$, and $R_d$ may be different from each other; M represents CO or NReCO, wherein $R_e$ represents a hydrogen atom or an alkyl group having 1 to 6 carbon atoms, when M is CO, $m_1$ is 1, and when $m_1$ is 0 and M is NReCO, B is not 0, and an oxalate compound represented by the following general formula (2) as a sensitizer, (2)

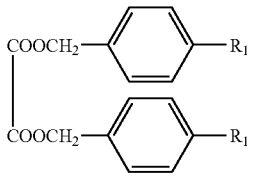

in the formula, R1 represents a hydrogen atom, a halogen atom, an alkyl group, or an alkoxy group.

In the present invention, reasons for the above-described thermally sensitive recording medium providing the excellent effects are not yet clarified. However, use of the color developing agent defined by the present invention and represented by the general formula (1) provides a high stability to light of a charge transfer complex which is a product of a reaction between a dye and the color developing agent, and favorable compatibility between the compound represented by the general formula (2) used as the sensitizer and the color developing agent represented by the general formula (1). Thus, the thermally sensitive recording medium having both sufficient color development sensitivity and thermal resistance can be obtained.

PREFERRED EMBODIMENT OF THE INVENTION

In order to obtain a thermally sensitive recording medium of the present invention, dispersion liquids prepared by dispersing a basic colorless dye (dye precursor), for example, a compound represented by the above general formula (1), or a compound represented by the above general formula (2), and a corresponding binder are mixed. Other necessary additives, such as a filler, are added thereto to prepare a coating liquid for a thermally sensitive recording layer. Then, the coating liquid is coated and dried on a substrate to thereby produce a thermally sensitive recording medium of the present invention.

In the present invention, the compound represented by the general formula (1) is used as the color developing agent. Of the compounds represented by the general formula (1), a compound having M representing NReCO is preferable, and a compound having M representing NHCO is more preferable. Specific examples of the compound include N-(2'-hydroxyphenylthio)acetyl-2-hydroxyaniline, N-(2'-hydroxhphenylthio)acetyl-3-hydroxyaniline, N-(2'-hydroxyphenylthio)acetyl-4-hydroxyaniline, N-(3'-hydroxyphenylthio)acetyl-2-hydroxyaniline, N-(3'-hydroxyphenylthio)acetyl-3-hydroxyaniline, N-(3'-hydroxyphenylthio)acetyl-4-hydroxyanilne, N-(4'-hydroxyphenylthio)acetyl-2-hydroxyanilne, N-(4'-hydroxyphenylthio)acetyl-3-hydroxyaniline, and N-(4'-hydroxyphenylthio)acetyl-4-hydroxyanilne, but the compound is not limited thereto. The compound represented by the general formula (1) can be used alone or together.

In particular, N-(4'-hydroxyphenylthio)acetyl-4-hydroxyaniline represented by the following formula (1-1) and N-(4'-hydroxyphenylthio)acetyl-2-hydroxyaniline represented by the following formula (1-2) are preferably used, and a 1:1 mixture thereof is more preferable. Such a mixture is available from Nippon Soda Co., Ltd. as D-100 (trade name), for example.

(1-1)

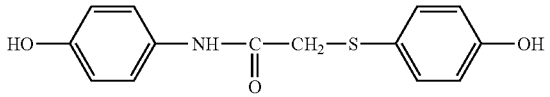

(1-2)

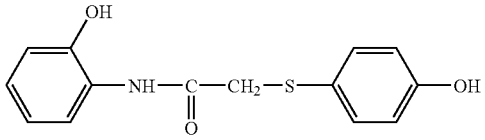

The present invention can employ a color-developing agent known in a field of conventional pressure sensitive or thermally sensitive recording paper without inhibiting the effects of the present invention, in addition to the above-described color developing agent. In the present invention, the use of the compound represented by the above general formula (2) as a sensitizer can provide a thermally sensitive recording medium having both sufficient color development sensitivity and thermal resistance. In the general formula (2), $R_1$ represents a hydrogen atom, a halogen atom such as chlorine or bromine, an alkyl group, or an alkoxy group. The alkyl group and the alkoxy group each preferably have 1 to 4 carbon atoms. Specific examples of the compound represented by the general formula (2) include dibenzyl oxalate, di(p-chlorobenzyl)oxalate, di(p-methylbenzyl)oxalate, and di(p-methoxybenzyl)oxalate. Of those, di(p-chlorobenzyl) oxalate is preferable from the viewpoint of favorable thermal resistance in a background portion, in particular.

Too small a mixing amount of the compound represented by the general formula (2) with respect to that of the compound represented by the general formula (1) hardly provides an improving effect on the color development sensitivity. Too large a mixing amount thereof tends to reduce the thermal resistance or to increase the print residue.

In the present invention, the compound represented by the general formula (2) is preferably used in a ratio of 0.01 part to 1.0 part with respect to 1 part of the compound represented by the general formula (1). In particular, a ratio of 0.16 part or more is more preferable because the image stability is further enhanced.

In the present invention, a leuco color development-type basic colorless dye is preferably used as the colorless or pale colored basic colorless dye. The leuco color development-type basic colorless dye may be any of those known in the field of conventional pressure sensitive or thermally sensitive recording paper, and is not particularly limited. Preferable examples thereof include a triphenylmethane-based compound, a fluorane-based compound, a fluorene-based compound, and a divinyl-based compound. Specific examples of typical color development-type basic colorless dyes are described below. The dye precursor can be used alone or together with.

<Triphenylmethane Type Leuco Dyes>

3,3-bis(p-dimethylaminophenyl)-6-dimethylaminophthalide, also known as Crystal Violet Lactone 3,3-bis(p-dimethylaminophenyl)phthalide, also known as Malachite Green Lactone <Fluorane Type Leuco Dyes>

3-diethylamino-6-methylfluorane
3-diethylamino-6-methyl-7-anilinofluorane
3-diethylamino-6-methyl-7-(o,p-dimethylanilino)fluorane
3-diethylamino-6-methyl-7-chlorofluorane
3-diethylamino-6-methyl-7-(m-trifluoromethylanilino)fluorane
3-diethylamino-6-methyl-7-(o-chloroanilino)fluorane
3-diethylamino-6-methyl-7-(p-chloroanilino)fluorane
3-diethylamino-6-methyl-7-(o-fluoroanilino)fluorane
3-diethylamino-6-methyl-7-(m-methylanilino)fluorane
3-diethylamino-6-methyl-7-n-octylanilinofluorane
3-diethylamino-6-methyl-7-n-octylaminofluorane
3-diethylamino-6-methyl-7-benzylanilinofluorane
3-diethylamino-6-methyl-7-dibenzylanilinofluorane
3-diethylamino-6-chloro-7-methylfluorane
3-diethylamino-6-chloro-7-anilinofluorane
3-diethylamino-6-chloro-7-p-methylanilinofluorane
3-diethylamino-6-ethoxyethyl-7-anilinofluorane
3-diethylamino-7-methylfluorane
3-diethylamino-7-chlorofluorane
3-diethylamino-7-(m-trifluoromethylanilino)fluorane
3-diethylamino-7-(o-chloroanilino)fluorane
3-diethylamino-7-(p-chloroanilino)fluorane
3-diethylamino-7-(o-fluoroanilino)fluorane
3-diethylamino-benzo[c]fluorane
3-diethylamino-benzo[c]fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-dibutylamino-6-methyl-7-(m-trifluoromethylanilino)fluorane
3-dibutylamino-6-methyl-chlorofluorane
3-dibutylamino-6-ethoxyethyl-7-anilinofluorane
3-dibutylamino-6-chloro-7-anilinofluorane
3-dibutylamino-6-methyl-7-p-methylanilinofluorane
3-dibutylamino-7-(o-chloroanilino)fluorane
3-dibutylamino-7-(o-fluoroanilino)fluorane
3-di-n-pentylamino-6-methyl-7-anilinofluorane
3-di-n-pentylamino-6-methyl-7-(p-chloroanilino)fluorane
3-di-n-pentylamino-7-(m-trifluoromethylaniliono)fluorane
3-di-n-pentylamino-6-chloro-7-anilinofluorane
3-di-n-pentylamino-7-(p-chloroanilino)fluorane
3-pyrrolidino-6-methyl-7-anilinofluorane
3-piperidino-6-methyl-7-anilinofluorane
3-(N-methyl-N-propylamino)-6-methyl-7-anilinofluorane
3-(N-methyl-N-cyclohexylamino)-6-methyl-7-anilinofluorane
3-(N-ethyl-N-cyclohexylamino)-6-methyl-7-anilinofluorane
3-(N-ethyl-N-xylamino)-6-methyl-7-(p-chloroanilino)fluorane
3-(N-ethyl-p-toluidino)-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-(N-ethyl-N-tetrahydrofurfurylamino)-6-methyl-7-anilinofluorane
3-(N-ethyl-N-isobutylamino)-6-methyl-7-anilinofluorane
3-(N-ethyl-N-ethoxypropylamino)-6-methyl-7-anilinofluorane
3-cyclohexylamino-6-chlorofluorane
2-(4-oxahexyl)-3-dimethylamino-6-methyl-7-anilinofluorane
2-(4-oxahexyl)-3-diethylamino-6-methyl-7-anilinofluorane
2-(4-oxahexyl)-3-dipropylamino-6-methyl-7-anilinofluorane
2-methyl-6-p-(p-dimethylaminophenyl)aminoanilinofluorane
2-methoxy-6-p-(p-dimethylaminophenyl)aminoanilinofluorane
2-chloro-3-methyl-6-p-(p-phenylaminophenyl)aminoanilinofluorane
2-chloro-6-p-(p-dimethylaminophenyl)aminoanilinofluorane
2-nitro-6-p-(p-diethylaminophenyl)aminoanilinofluorane
2-amino-6-p-(p-diethylaminophenyl)aminoanilinofluorane
2-diethylamino-6-p-(p-diethylaminophenyl)aminoanilinofluorane
2-phenyl-6-methyl-6-p-(p-phenylaminophenyl)aminoanilinofluorane
2-benzyl-6-p-(p-phenylaminophenyl)aminoanilinofluorane
2-hydroxy-6-p-(p-phenylaminophenyl)aminoanilinofluorane
3-methyl-6-p-(p-dimethylaminophenyl)aminoanilinofluorane
3-diethylamino-6-p-(p-diethylaminophenyl)aminoanilinofluorane
3-diethylamino-6-p-(p-dibutylaminophenyl)aminoanilinofluorane
2,4-dimethyl-6-[(4-dimethylamino)anilino]-fluorane <Fluorene Type Leuco Dyes>

3,6,6'-tris(dimethylamino)spiro[fluorene-9,3'-phthalide]
3,6,6'-tris(diethylamino)spiro[fluorene-9,3'-phthalide]

<Divinyl Type Leuco Dyes>

3,3-bis-[2-(p-dimethylaminophenyl)-2-(p-methoxyphenyl)ethenyl]-4,5,6,7-tetrabromo phthalide
3,3-bis-[2-(p-dimethylaminophenyl)-2-(p-methoxyphenyl)ethenyl]-4,5,6,7-tetrachloro phthalide
3,3-bis-[1,1-bis(4-pyrrolidinophenyl)ethylene-2-yl]-4,5,6,7-tetrabromophthalide
3,3-bis-[1-(4-methoxyphenyl)-1-(4-pyrrolidinophenyl)ethylene-2-yl]-4,5,6,7-tetra chlorophthalide <Others>

3-(4-diethylamino-2-ethoxyphenyl)-3-(1-ethyl-2-methylindol-3-yl)-4-azaphthalide 3-(4-diethylamino-2-ethoxyphenyl)-3-(1-octyl-2-methylindol-3-yl)-4-azaphthalide 3-(4-cyclohexylethylamino-2-methoxyphenyl)-3-(1-ethyl-2-methylindol-3-yl)-4-azaphthalide 3,3-bis(1-ethyl-2-methylindol-3-yl)phthalide 3,6-bis(diethylamino)fluorane-?-(3'-nitro)anilinolactam 3,6-bis(diethylamino)fluorane-?-(4'-nitro)anilinolactam 1,1-bis-[2',2',2",2"-tetrakis-(p-dimethylaminophenyl)-ethenyl]-2,2-dinitrilethane 1,1-bis-[2',2',2", 2"-tetrakis-(p-dimethylaminophenyl)-ethenyl]-2-β-naphthoyl ethane 1,1-bis-[2',2',2", 2"-tetrakis-(p-dimethylaminophenyl)-ethenyl]-2,2-diacetylethane bis-[2,2,2',2'-tetrakis-(p-dimethylaminophenyl)-ethenyl]-methylmalonic acid dimethyl ester.

Among those dyes, a basic colorless dye having a melting point of 200° C. or higher is preferable, and 3-(N-ethyl-p-toluidino)-6-methyl-7-anilinofluoroane (ETAC, available from Yamada Chemical Co., Ltd., melting point of 206 to 208° C.) or 3-diethylamino-6-methyl-7-(m-methylanilino) fluorane (ODB-7) is particularly preferable. Although the reasons are not clear, even when a basic colorless dye having a melting point of 200° C. or higher, in particular, 3-(N-ethyl-p-toluidino)-6-methyl-7-anilinofluorane (ETAC) is exposed to light (UV light), the dye is hardly decomposed (dealkylated) and colored, to presumably provide a high base stability to light. The use of the compound represented by the general formula (1) as a color developing agent provides a very high stability to light of a color developing agent formed by heat such that fading by light rarely occurs.

Further, in the case of 3-diethylamino-6-methly-7-(m-methylanilino) fluorane (ODB-7), it has a high polarity, and equilibrium of a reaction by thermal energy presumably stabilizes on a side of the color developing agent. A substituent of an amino group at a 3-position is an ethyl group, and the dye is not as bulky as 3-dibutylamino-6-methyl-7-anilinofluorane (OBD-2) or the like generally used. Thus, a bond between the dye and the color developing agent becomes stronger, to presumably provide a stable color image.

Therefore, an image which withstands the adverse effects of a substance such as a plasticizer is formed, to presumably produce an image having a very high stability.

The present invention can add a color image stabilizer in the range where it does not inhibit the desired effects for the above-described object. Examples of the image stabilizer that can be added include: 4,4'-butylidene(6-t-butyl-3-methylphenol), 2,2'-di-t-butyl-5,5'-dimethyl-4,4'-sulfonyldiphenol, 1,1,3-tris(2-methyl-4-hydroxy-5-cyclohexylphenyl)butane or 1,1,3-tris(2-methyl-4-hydroxy-5-t-butylphenyl)butane. The image stabilizer particularly preferably contains at least one compound selected from the group consisting of: 3-{[(phenylamino)carbonyl]amino} benzenesulfonamide represented by the following general formula (3), a urea urethane compound represented by the following general formula (4), an epoxy group-containing diphenylsulfone compound represented by the following general formula (5), a diphenylsulfone-type oligomer compound represented by the following general formula (6) and a copolymer of glycidyl methacrylate and a vinyl monomer (average molecular weight of 9,000 to 11,000, epoxy equivalent of 300 to 600, and a melting point of 110° C. or lower).

(3)

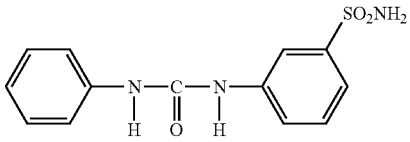

(5)

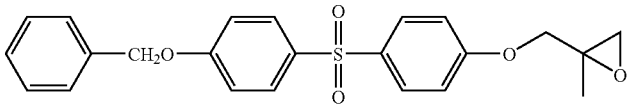

(4)

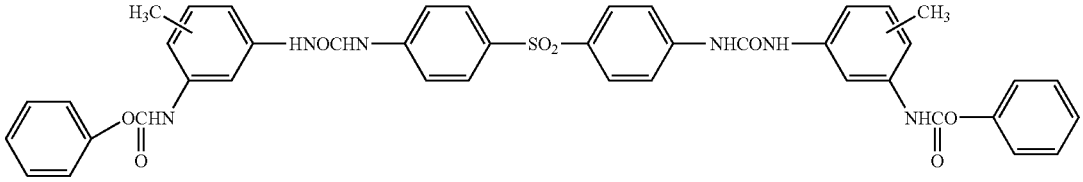

(6)

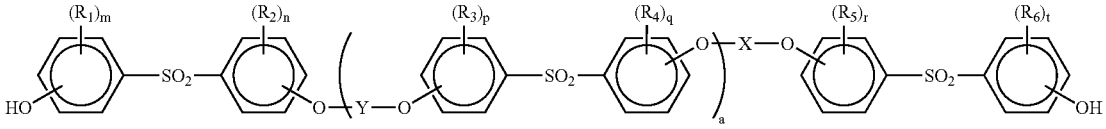

In the formulae, X and Y may be different from each other and each represent a hydrocarbon group having 1 to 12 carbon atoms which may be linear or branched and may have a saturated, unsaturated, or an ether bond. Alternatively, X and Y each may be represented by the following formulae.

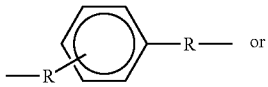

-continued

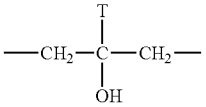

(wherein: R represents a methylene group or an ethylene group; and T represents a hydrogen atom or an alkyl group having 1 to 4 carbon atoms.) $R_1$ to $R_6$ each independently represent a halogen atom, an alkyl group having 1 to 6 carbon atoms, or an alkenyl group. m, n, p, q, r, and t each represent an integer of 0 to 4; and when m, n, p, q, r, and t each are 2 or more, $R_1$ to $R_6$ may be different from each other. a represents an integer of 0 to 10.

The reasons for the stabilizers having the structures (3) to (6) to be particularly preferable are not clear, but the stabilizers each have a high stability to light of a charge transfer complex (color developing agent), which is a reaction product of the dye, the color developing agent represented by the general formula (1), and the sensitizer represented by the general formula (2). The compound represented by the general formula (3) has a urea group acting on a color developing agent to presumably stabilize an image. The compound represented by the general formula (4) has a urea group or a urethane group acting on a color developing agent to presumably stabilize an image. The compound having an epoxy group as is represented by the general formula (5) acts on the dye or the color developing agent to presumably inhibit fading or stabilize a color image. The compound represented by the general formula (6) has a large molecular weight and low solubility to a plasticizer or the like of a color developing agent. As a result, even when the compound is brought into contact with a plasticizer or the like, an image does not fade.

Too small a mixing amount of the stabilizer with respect to that of the color developing agent represented by the general formula (1) hardly provides a stabilizing effect on an image. Too large a mixing amount thereof tends to reduce the sensitivity or thermal resistance. In the present invention, the compound is preferably used in a ratio of 0.01 parts to 0.9 parts with respect to 1 part of the compound represented by the general formula (1). In particular, a ratio of 0.16 parts or more is more preferable because the image storage stability with respect to a plasticizer is further enhanced.

The present invention may employ a conventionally known sensitizer without inhibiting the desired effects for the above-described object. Examples of the sensitizer include saturated fatty monoamides, ethylenebis fatty amides, montan wax, polyethylene wax, 1,2-di(3-methylphenoxy)ethane, p-benzylbiphenyl, β-benzyloxynaphthalene, 4-biphenyl-p-tolyl ether, m-terphenyl, 1,2-diphenoxyethane, 4,4'-ethylenedioxy-bis-dibenzyl benzoate, dibenzoyloxymethane, 1,2-di(3-methylphenoxy)ethylene, 1,2-diphenoxyethylene, bis[2-(4-methoxy-phenoxy)ethyl] ether, methyl p-nitrobenzoate, benzyl p-benzyloxy benzoate, di-p-tolyl carbonate, phenyl-a-naphythyl carbonate, 1,4-diethoxy naphthalene, phenyl 1-hydroxy-2-naphthoate, 4-(m-methylphenoxymethyl)biphenyl, 1,2-bis(phenoxymethyl) benzene, paratoluenesulfonamide, and orthotoluenesulfonamide. However, the sensitizer is not particularly limited thereto.

Examples of the binder that can be used in the present invention include: completely saponified polyvinyl alcohol having a degree of polymerization of 200 to 1,900; partially saponified polyvinyl alcohol; carboxy-modified polyvinyl alcohol; amide-modified polyvinyl alcohol; sulfonic acid-modified polyvinyl alcohol; butyral-modified polyvinyl alcohol; other modified polyvinyl alcohol; hydroxyethylcellulose; methylcellulose; carboxymethylcellulose; a styrene-maleic anhydride copolymer; a styrene-butadiene copolymer; a cellulose derivative such as ethylcellulose or acetylcellulose; polyvinyl chloride, polyvinyl acetate, polyacrylamide, polyacrylate, polyvinyl butyral, polystyrol, and a copolymer thereof; a polyamide resin; a silicon resin; a petroleum resin; a terpene resin; a ketone resin; and a cumarone resin. Those high molecular weight substances can be used by: dissolving in a solvent such as water, an alcohol, a ketone, an ester, or a hydrocarbon; or emulsifying or dispersing as a paste in water or another medium. Both methods can be used together in accordance with the required quality.

Examples of the filler that can be used in the present invention include an inorganic or organic filler such as silica, calcium carbonate, kaolin, calcined kaolin, diatomaceous earth, talc, titanium oxide, or aluminum hydroxide. Other examples of the filler that can be used include: lubricants such as waxes; benzophenone-based or triazole-based UV absorbers; water-resistant additives such as glyoxal; dispersants; antifoaming agents; antioxidants; and fluorescent dyes.

An amount of the color developing agent or dye and the types or amounts of other various components used for the thermally sensitive recording medium of the present invention are determined in accordance with the required performance and recordability and are not particularly limited. However, 0.1 to 2 parts of the basic colorless dye and 0.5 to 4 parts of the filler are generally used with respect to 1 part of the color developing agent represented by the general formula (1), and the binder is appropriately used in 5 to 25% of the total solid content.

The coating liquid having the above-described composition is coated on an arbitrary support such as paper, recycled paper, synthetic paper, a film, a plastic film, a foamed plastic film, or a nonwoven fabric, to thereby obtain the target thermally sensitive recording sheet. A composite sheet prepared by combining those supports may be used as a support.

An overcoat layer formed of a high molecular weight substance or the like may be provided on the thermally sensitive recording layer for the purpose of enhancing the storage stability. Alternatively, an undercoat layer formed of a high molecular weight substance or the like containing a filler may be provided below the thermally sensitive recording layer for the purpose of enhancing the color development sensitivity.

The above-described organic color developing agent, basic colorless dye, and materials added as required are finely pulverized to a particle size of several microns or less by using a pulverizer such as a ball mill, an attritor, or a sand grinder, or an appropriate emulsifier. Then, a binder and various additive materials in accordance with the purpose are added, to thereby prepare a coating liquid. The coating means is not particularly limited, and the coating liquid can be coated following a known conventional technique. Examples of the coating means that is arbitrarily selected and used include off-machine coaters or on-machine coaters provided with various coaters such as an air knife coater, a rod blade coater, a bill blade coater, a roll coater, and a curtain coater.

In the present invention, inkjet recordability can be provided on the support for the above-described thermally sensitive recording medium on a side opposite to the thermally sensitive recording layer. Means for providing the inkjet recordability are described below.

(1) A coating liquid containing as main materials a water-soluble polymer, a water-soluble inorganic salt containing metal ions of divalent or more, and a cationic resin having a cationic degree of 4 to 8 meq/g or more and a molecular weight of 100,000 or more is coated or impregnated.

(2) A surface of the support to be provided with the inkjet recording layer has a Cobb water absorption of 30 g/m$^2$ or more.

(3) The support has a multilayer structure of at least two layers, and an outermost layer of the surface opposite to the thermally sensitive recording layer is a layer having a high filler content satisfying ink receptivity.

A case where the inkjet printability is provided on the back surface of the thermally sensitive recording medium will be described in more detail.

In such a case, an uncoated paper (base paper) formed of a wood cellulose fiber as a raw material is used as a support, and the paper is mainly constituted of paper pulp. Examples of the paper pulp include: chemical pulp such as LBKP or NBKP; mechanical pulp such as GP or TMP; and recycled pulp. The present invention is not particularly limited thereto, and the paper pulp may be used alone or in combination as required. Further, other vegetable fibers, synthetic fibers, or inorganic fibers can be mixed therein.

Examples of the filler incorporated into the base paper include known fillers such as heavy calcium carbonate, light precipitated calcium carbonate, magnesium carbonate, calcium/magnesium carbonate, kaolin, calcined clay, bentonite, sericite, zeolite, natural silicates such as talc, synthetic silicates such as synthetic aluminum silicate or synthetic calcium silicate, silicas such as diatomaceous earth or synthetic silica, aluminum hydrates such as aluminum hydroxide or pseudoboehmite, calcium sulfate, titanium dioxide, and zinc oxide. Of those, talc, kaolin, calcium carbonate, titanium dioxide, and the like are generally used.

Other various internal chemicals such as a sizing agent and a paper strength additive are not particularly limited, and can be arbitrarily selected from known various internal chemicals for use. An antifoaming agent, a pH adjuster, a surfactant, a dye or colored pigment for adjusting the hue, a fluorescent dye for improving visual whiteness, or the like can also be incorporated. However, too high a sizing property tends to reduce an ink absorption rate and accelerate bleeding. Thus, a Stockigt size of the inkjet recording surface is desirably 0 to 3 seconds.

In the case (1), although the reasons are not clear, a coating liquid containing as main materials a water-soluble polymer, a water-soluble inorganic salt containing metal ions or divalent or more, and a cationic resin having a cationic degree of 4 to 8 meq/g or more and a molecular weight of 100,000 or more is coated or impregnated, to thereby provide excellent effects on the inkjet recording surface to have a good balance between feathering and bleeding, to allow high quality printing, and to have a high ink water-resistance. In this case, the water-soluble inorganic salt containing metal ions of divalent or more used in the coating liquid suppresses the occurrence of feathering and improves the color development of the ink. Examples of the water-soluble inorganic salt containing metal ions of divalent or more include zinc chloride, zinc nitrate, aluminum chloride, aluminum nitrate, aluminum sulfate, cadmium chloride, calcium chloride, chlorides of rare earth metals, cerium chloride, cobalt chloride, titanium trichloride, chromic chloride, stannous chloride, ferrous chloride, ferric chloride, cupric chloride, lead chloride, nickel chloride, vanadium trichloride, barium chloride, magnesium chloride, magnesium nitrate, magnesium sulfate, manganese chloride, and manganese sulfate. Magnesium nitrate and magnesium sulfate are preferably used from the viewpoint of suppressing feathering which is apt to occur in the use of recycled pulp as base paper. Further, magnesium nitrate and magnesium sulfate are preferable from the viewpoint of improving color development.

An adhered amount of the water-soluble inorganic salt containing metal ions of divalent or more that can be used on the inkjet recording surface of the present invention is desirably 0.1 to 1.5 g/m$^2$ per surface. With an adhered amount of less than 0.1 g/m$^2$, favorable color development is hardly obtained. With an adhered amount of 1.5 g/m$^2$ or more, no further effects can be expected. Specific examples of the water-soluble polymer used for the coating liquid include starch, oxidized starch, phosphate starch, cationic starch, completely saponified polyvinyl alcohol, partially saponified polyvinyl alcohol, cation-modified polyvinyl alcohol, silanol-modified polyvinyl alcohol, anion-modified polyvinyl alcohol, and casein. The water-soluble polymer may be used alone or in combination as required. In particular, polyvinyl alcohol is preferably used because of favorable color development owing to transparency of the binder.

Examples of the cationic resin used for the coating liquid include chemicals generally used as ink-fixing agents such as a dicyandiamide/alkylamine-based polymer compound, a dicyandiamide/formalin-based polymer compound, a polyethyleneimine derivative, an alkylamine/epichlorohydrin-based polymer compound, an ammonia/epichlorohydrin-based polymer compound, a polymethacrylic acid-based quaternary ammonium salt derivative, and a dimethyldiallylammonium chloride-based polymer.

Of those, the cationic resin desirably has a cationic degree of 4 to 8 meq/g from the viewpoint of ink water-resistance and color developing ability. A cationic degree of the cationic resin of less than 4 meq/g provides insufficient water resistance in a printed portion, and a cationic degree thereof of 8 meq/g or more provides favorable water resistance but poor color development in the printed portion.

The cationic resin has a molecular weight of preferably 100,000 or more, more preferably 100,000 to 10,000,000 from the viewpoint of ink water-resistance in the printed portion. A cationic resin having a molecular weight of 100,000 or less provides a reduced ink water-resistance in the printed portion, and the cationic resin having a molecular weight of 10,000,000 or more provides a favorable ink water-resistance on the printed portion but has a high viscosity itself causing problems of difficulties in the handling thereof.

An adhered amount of the cationic resin that can be used on the inkjet recording surface is desirably 0.2 to 1.5 g/m$^2$ per surface. With an adhered amount of less than 0.2 g/m$^2$, insufficient water resistance is provided. With an adhered amount of 1.5 g/m$^2$ or more, no further effects of the water resistance can be expected.

The inkjet recording surface of the present invention can be produced through: a method involving impregnating a base paper with the above-described coating liquid containing as main materials a water-soluble polymer, a water-soluble inorganic salt containing metal ions of divalent or more, and a cationic resin having a cationic degree of 4 to 8 meq/g or more and a molecular weight of 100,000 or more and drying; or a method involving coating the coating liquid on a surface of base paper and drying. For example, the impregnation method may employ an impregnation-type size press device. In this case, the base paper is impregnated with the coating liquid and then a coating liquid for a thermally sensitive recording layer must be coated thereon. The method of coating the coating liquid on the surface of the base paper may employ a known coating device such as a roll coater, a gravure coater, a gate roll coater, or a shim sizer. In this case, the above-described coating liquid is coated on the base paper, and then the coating liquid for a thermally sensitive recording layer may be coated on the opposite surface, or the two coating liquids may be coated in the opposite order.

A drying method may be a usual method employing a steam heater, a gas heater, an infrared heater, an electric heater, a hot air heater, a microwave, or a cylinder drier. After the drying, smoothness may be provided through a finishing step such as supercalendering or soft calendering, which is a post processing step. Other general paper processing can be used.

In case (2), the inkjet recording layer contains a pigment and a binder. A general pigment is synthetic silica, but other examples of the pigment include: inorganic pigments such as alumina or alumina hydrate (including alumina sol, colloidal alumina, or pseudoboehmite), aluminum silicate, magnesium silicate, magnesium carbonate, precipitated calcium carbonate light, calcium carbonate heavy, kaolin, talc, calcium sulfate, titanium dioxide, zinc oxide, zinc carbonate, calcium silicate, and aluminum hydroxide; and organic pigments such as a plastic pigment and a urea resin.

The binder is used for the inkjet recording layer to maintain properties as a coated film. Examples of the binder that can be used include polyvinyl alcohol and a modified product thereof, vinyl acetate, oxidized starch, etherified starch, casein, gelatin, soybean protein, carboxymethylcellulose, SB latex, NB latex, acryl latex, ethylene vinyl acetate-based latex, polyurethane, and an unsaturated polyester resin. In the present invention, at least one type of binder may be used, and a mixing amount thereof is preferably 5 to 60 parts by weight with respect to 100 parts by weight of the pigment. Too small a mixing amount of the binder provides an insufficient surface strength, and too large a mixing amount thereof provides an insufficient ink-absorbing ability. The ink recording layer is constituted by coating a coating liquid containing the above-described pigment and binder.

In the present invention, two or more layers of the inkjet recording layers may be provided. Two or more layers of the inkjet recording layers are preferably provided to facilitate the adjustment of the glossiness. Too small a coating amount of the inkjet recording layer provides insufficient absorption of an ink solvent, and bleeding is apparently observed in a mixed color image, in particular. Too large a coating amount of the inkjet recording layer undesirably provides insufficient surface strength such that a coated layer may fall off as a powder from the support when the rolled recording layer is formed into flat sheets or cut into a small size, a coated layer may fall just by rubbing a printed portion, etc. The coating amount of the inkjet recording layer may be arbitrarily determined in accordance with the purpose, but the coating amount is preferably 3 to 20 g/m$^2$, particularly preferably 5 to 15 g/m$^2$ per inkjet recording layer.

Further, the inkjet recording layer may have a pigment dispersant, a thickener, an antifoaming agent, a foam suppressor, a releasing agent, a foaming agent, a colored dye, a colored pigment, a fluorescent dye, a UV absorber, an antioxidant, a preservative, a water resistor, a surfactant, a wet paper strength additive, or the like arbitrarily added without inhibiting the effects of the present invention.

Various devices which are general coating devices such as a blade coater, a roll coater, an air knife coater, a bar coater, a gate roll coater, a curtain coater, a short dwell coater, a gravure coater, a flexogravure coater, and a size press can be used on-machine or off-machine for providing the inkjet recording layer on the surface of the support. Further, in the present invention, the surfaces of the support and inkjet recording layer can be subjected to surface treatment by using a device for calendering or the like such as machine calendering, supercalendering, or soft calendering without inhibiting the effects of the present invention.

A Cobb water absorption of the surface of the support to be provided with the inkjet recording layer is 30 g/m$^2$ or more. A Cobb water absorption of 30 g/m$^2$ or more can provide sufficient color developing ability and ink absorbing ability even when the inkjet recording layer provided on the surface of the support is subjected to printing high speed using multicolor ink and an inkjet recording printer. In contrast, a Cobb water absorption of less than 30 g/m$^2$ inhibits sufficient absorption of the ink in the support, which may provide adverse effects on the thermally sensitive recording layer on the opposite surface or may cause bleeding at an interface between colored inks. A desired Cobb water absorption can be obtained by adjusting the type or addition amount of sizing agent to adjust a sizing degree.

The case (3) can be attained by providing: the support having a multilayer structure of at least two layers; a layer having a high filler content satisfying the desired ink receptivity as an inkjet recording surface on a back surface; and a base paper for thermally sensitive recording satisfying the desired thermally sensitive recording properties as a layer on the opposite surface.

The pulp, fiber, filler, other chemicals, various additives, and the like constituting the base paper may be the same as those described above. The layer having a high filler content preferably has a filler content of 5 to 40 wt % with respect to a solid weight of pulp. Further, one layer or two or more layers of the inkjet recording layers as described above may be provided on the layer having a high filler content.

The base paper is made by: beating pulp; adding a filler; adding a conventionally known sizing agent, fixing agent, retention aid, or paper strength additive as required; mixing the whole; and making paper using a wire paper machine, a cylinder paper machine, a twin wire paper machine, or the like. Then, a layer having a desired filler content is produced by separately making a layer having a high filler content and a layer having a low content filler and attaching the layers together. Alternatively, the layer having a desired filler content is produced at once using a multilayer paper machine.

EXAMPLES

Hereinafter, a thermally sensitive recording medium of the present invention will be described by way of examples. In the description, parts and % refer to parts by weight and wt % unless otherwise noted.

Example 1

Materials for a dye, color developing agent, and sensitizer were prepared into respective dispersion liquids having the following compositions. Each dispersion liquid was subjected to wet milling using a sand grinder to an average particle size of 0.5 μm.

| <Dispersion of color developing agent> | |
|---|---|
| 1:1 Mixture of N-(4'-hydroxyphenylthio)acetyl-4-hydroxyaniline and N-(4'-hydroxyphenylthio)acetyl-2-hydroxyaniline (trade name: D-100, available from Nippon Soda Co., Ltd.) | 6.0 parts |
| 10% Aqueous solution of polyvinyl alcohol | 18.8 parts |
| Water | 11.2 parts |
| <Dye dispersion liquid> | |
| 3-Di-n-butylamino-6-methyl-7-anilinofluorane (OBD-2) | 3.0 parts |
| 10% Aqueous solution of polyvinyl alcohol | 6.9 parts |
| Water | 3.9 parts |
| <Sensitizer dispersion liquid> | |
| Di(p-chlorobenzyl)oxalate | 6.0 parts |
| 10% Aqueous solution of polyvinyl alcohol | 18.8 parts |
| Water | 11.2 parts |

The dispersion liquids were mixed in the following ratio to prepare a composition as a coating liquid for a thermally sensitive recording layer. The coating liquid was coated and dried on a surface of a base paper having a basic weight of 80 g/m$^2$ such that the coating amount after drying was 6 g/m$^2$. The resultant coated paper was subjected to supercalendering treatment to a Bekk smoothness of 200 to 600 sec, to thereby obtain a thermally sensitive recording medium.

| | |
|---|---|
| Dispersion of color developing agent | 36.0 parts |
| Dye dispersion liquid | 13.8 parts |
| Sensitizer dispersion liquid | 36.0 parts |
| 50% Dispersion liquid of kaolin clay | 26.0 parts |
| 30% Dispersion liquid of zinc stearate | 6.7 parts |

Example 2

A stabilizer dispersion liquid having the following composition was prepared, and the dispersion liquid was subjected to wet milling using a sand grinder to an average particle size of 0.5 μm.

| <Stabilizer dispersion liquid> | |
|---|---|
| 3-{[(Phenylamino)carbonyl]amino}benzenesulfonamide (SU-727) | 3.0 parts |
| 10% Aqueous solution of polyvinyl alcohol | 9.4 parts |
| Water | 5.6 parts |

The above-described stabilizer dispersion liquid was added to the dispersion liquids prepared in Example 1 in the following ratio and the following compositions were mixed, to thereby obtain a coating liquid for a thermally sensitive recording layer.

| | |
|---|---|
| Dispersion of color developing agent | 36.0 parts |
| Dye dispersion liquid | 13.8 parts |
| Sensitizer dispersion liquid | 36.0 parts |
| Stabilizer dispersion liquid | 9.0 parts |
| 50% Dispersion liquid of kaolin clay | 26.0 parts |
| 30% Dispersion liquid of zinc stearate | 6.7 parts |

The coating liquid was coated and dried on a surface of a base paper having a basic weight of 80 g/m$^2$ such that the coating amount after drying was 6 g/m$^2$. The resultant coated paper was subjected to supercalendering treatment to a Bekk smoothness of 200 to 600 sec, to thereby obtain a thermally sensitive recording medium.

Example 3

A dispersion liquid containing a urea-urethane stabilizer (abbreviated as UU) represented by the following chemical formula (4) was prepared, and the dispersion liquid was subjected to wet milling using a sand grinder to an average particle size of 0.5 μm.

<Stabilizer dispersion liquid>

(4)

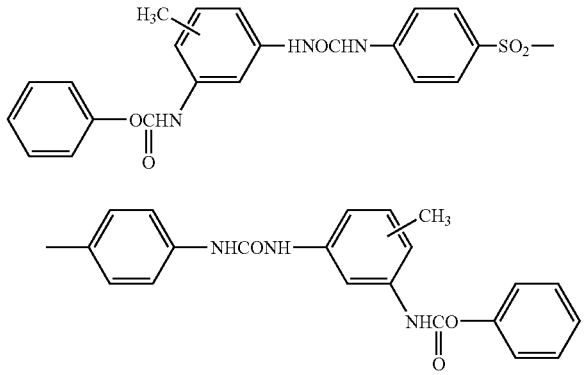

| | |
|---|---|
| (UU) | 3.0 parts |
| 10% Aqueous solution of polyvinyl alcohol | 9.4 parts |
| Water | 5.6 parts |

The above-described stabilizer dispersion liquid was mixed into the dispersion liquids prepared in Example 1 in the following ratio, to thereby obtain a coating liquid for a thermally sensitive recording layer.

| | |
|---|---|
| Dispersion of color developing agent | 36.0 parts |
| Dye dispersion liquid | 13.8 parts |
| Sensitizer dispersion liquid | 36.0 parts |
| Stabilizer dispersion liquid | 9.0 parts |
| 50% Dispersion liquid of kaolin clay | 26.0 parts |
| 30% Dispersion liquid of zinc stearate | 6.7 parts |

The coating liquid was coated and dried on a surface of a base paper having a basic weight of 80 g/m$^2$ such that the coating amount after drying was 6 g/m$^2$. The resultant coated paper was subjected to supercalendering treatment to a Bekk smoothness of 200 to 600 sec, to thereby obtain a thermally sensitive recording medium.

Example 4

A stabilizer dispersion liquid having the following composition was prepared, and the stabilizer dispersion liquid was subjected to wet milling using a sand grinder to an average particle size of 0.5 μm.

| <Stabilizer dispersion liquid> | |
|---|---|
| 4-benzyloxy-4'-(2,3-epoxy-2-methylpropoxy)diphenylsulfone (trade name: NTZ-95, available from Nippon Soda Co., Ltd.) | 3.0 parts |
| 10% Aqueous solution of polyvinyl alcohol | 9.4 parts |
| Water | 5.6 parts |

The above-described stabilizer dispersion liquid was added to the dispersion liquids prepared in Example 1 in the following ratio, to thereby obtain a coating liquid for a thermally sensitive recording layer.

| | |
|---|---|
| Dispersion of color developing agent | 36.0 parts |
| Dye dispersion liquid | 13.8 parts |
| Sensitizer dispersion liquid | 36.0 parts |
| Stabilizer dispersion liquid | 9.0 parts |
| 50% Dispersion liquid of kaolin clay | 26.0 parts |
| 30% Dispersion liquid of zinc stearate | 6.7 parts |

The coating liquid was coated and dried on a surface of a base paper having a basic weight of 80 g/m$^2$ such that the coating amount after drying was 6 g/m$^2$. The resultant coated paper was subjected to supercalendering treatment to a Bekk smoothness of 200 to 600 sec, to thereby obtain a thermally sensitive recording medium.

Example 5

A stabilizer dispersion liquid having a diphenylsulfone crosslinking-type compound (trade name: D-90, available from Nippon Soda Co., Ltd.) mixed as a stabilizer was prepared. The dispersion liquid was subjected to wet milling using a sand grinder to an average particle size of 0.5 μm.

| <Stabilizer dispersion liquid> | |
|---|---|
| Diphenylsulfone crosslinking-type compound (trade name: D-90, available from Nippon Soda Co., Ltd.) | 3.0 parts |
| 10% Aqueous solution of polyvinyl alcohol | 9.4 parts |
| Water | 5.6 parts |

The above-described stabilizer dispersion liquid was mixed into the dispersion liquids prepared in Example 1 in the following ratio, to thereby obtain a coating liquid for a thermally sensitive recording layer.

| | |
|---|---|
| Dispersion of color developing agent | 36.0 parts |
| Dye dispersion liquid | 13.8 parts |
| Sensitizer dispersion liquid | 36.0 parts |
| Stabilizer dispersion liquid | 9.0 parts |
| 50% Dispersion liquid of kaolin clay | 26.0 parts |
| 30% Dispersion liquid of zinc stearate | 6.7 parts |

The coating liquid was coated and dried on a surface of a base paper having a basic weight of 80 g/m$^2$ such that the coating amount after drying was 6 g/m$^2$. The resultant coated paper was subjected to supercalendering treatment to a Bekk smoothness of 200 to 600 sec, to thereby obtain a thermally sensitive recording medium.

Example 6

A stabilizer dispersion liquid having a copolymer (average molecular weight of 9,000 to 11,000, epoxy equivalent of 300 to 600, melting point of 110° C. or lower, trade name: NER-064, available from Nagase Chemicals Ltd.) of glycidyl methacrylate and a vinyl monomer, which is a compound having an epoxy group, mixed as a stabilizer was prepared. The dispersion liquid was subjected to wet milling using a sand grinder to an average particle size of 0.5 μm.

| <Stabilizer dispersion liquid> | |
|---|---|
| Compound containing an epoxy group (trade name: NER-064, available from Nagase Chemicals Ltd.) | 3.0 parts |
| 10% Aqueous solution of polyvinyl alcohol | 9.4 parts |
| Water | 5.6 parts |

The above-described stabilizer dispersion liquid was mixed into the dispersion liquids prepared in Example 1 in the following ratio, to thereby obtain a coating liquid for a thermally sensitive recording layer.

| | |
|---|---|
| Dispersion of color developing agent | 36.0 parts |
| Dye dispersion liquid | 13.8 parts |
| Sensitizer dispersion liquid | 36.0 parts |
| Stabilizer dispersion liquid | 9.0 parts |
| 50% Dispersion liquid of kaolin clay | 26.0 parts |
| 30% Dispersion liquid of zinc stearate | 6.7 parts |

The coating liquid was coated and dried on a surface of a base paper having a basic weight of 80 g/m$^2$ such that the coating amount after drying was 6 g/m$^2$. The resultant coated paper was subjected to supercalendering treatment to a Bekk smoothness of 200 to 600 sec, to thereby obtain a thermally sensitive recording medium.

Example 7

The following dye dispersion liquid was prepared instead of the (ODB-2) dye dispersion liquid of Example 1 in the same manner as in Example 1 except that 3-(N-ethyl-p-toluidino)-6-methyl-7-anilionofluorane (ETAC) was used as a dye.

| <Dye dispersion liquid> | |
|---|---|
| (ETAC) | 3.0 parts |
| 10% Aqueous solution of polyvinyl alcohol | 6.9 parts |
| Water | 3.9 parts |

The dye dispersion liquid was used instead of the dye dispersion liquid shown in Example 1 and was mixed in the same ratio as that shown in Example 1 to obtain a coating liquid for a thermally sensitive recording layer. A thermally sensitive recording medium was produced in the same manner as in Example 1 by using the coating liquid.

Example 8

The following dye dispersion liquid was prepared instead of the (ODB-2) dye dispersion liquid of Example 1 in the same manner as in Example 1 except that 3-diethylamino-6-methyl-7-(methylanilino)fluorane (ODB-7) was used as a dye.

| <Dye dispersion liquid> | |
|---|---|
| (OBD-7) | 3.0 parts |
| 10% Aqueous solution of polyvinyl alcohol | 6.9 parts |
| Water | 3.9 parts |

The dye dispersion liquid was used instead of the dye dispersion liquid shown in Example 1 and was mixed in the same ratio as that shown in Example 1 to obtain a coating liquid for a thermally sensitive recording layer. A thermally sensitive recording medium was produced in the same manner as in Example 1 by using the coating liquid for a thermally sensitive recording layer.

Example 9

The following sensitizer dispersion liquid was prepared instead of the dispersion liquid of di(p-chlorobenzyl)oxalate, which is a sensitizer, in the same manner as in Example 1 except that di(p-methylbenzyl)oxalate (HS-3520) was used as a sensitizer.

| <Sensitizer dispersion liquid> | |
|---|---|
| Di(p-methylbenzyl)oxalate | 6.0 parts |
| 10% Aqueous solution of polyvinyl alcohol | 18.8 parts |
| Water | 11.2 parts |

The sensitizer dispersion liquid was used instead of the sensitizer dispersion liquid shown in Example 1 and was mixed in the same ratio as that shown in Example 1 to obtain a coating liquid for a thermally sensitive recording layer. A thermally sensitive recording medium was produced in the same manner as in Example 1 by using the coating liquid for a thermally sensitive recording layer.

Example 10

The following sensitizer dispersion liquid was prepared instead of the dispersion liquid of di(p-chlorobenzyl)oxalate, which is a sensitizer, in the same manner as in Example 1 except that dibenzyl oxalate (HS-2046) was used as a sensitizer.

| <Sensitizer dispersion liquid> | |
|---|---|
| Dibenzyl oxalate | 6.0 parts |
| 10% Aqueous solution of polyvinyl alcohol | 18.8 parts |
| Water | 11.2 parts |

The sensitizer dispersion liquid was used instead of the sensitizer dispersion liquid shown in Example 1 and was mixed in the same ratio as that shown in Example 1 to obtain a coating liquid for a thermally sensitive recording layer. A thermally sensitive recording medium was produced in the same manner as in Example 1 by using the coating liquid for a thermally sensitive recording layer.

Comparative Examples 1 to 4

Each thermally sensitive recording medium was produced in the same manner as in Example 1 with the same composition etc. except that the materials of Table 1 were used as a color developing agent and a sensitizer.

The thermally sensitive recording medium obtained in each of Examples 1 to 10 and Comparative Example 1 to 4 was evaluated for performance through the following method.

Abbreviations for the respective color developing agents and sensitizers of Comparative Examples shown in Table 1 are described below.

| | |
|---|---|
| 2,4'-BPS: | 2,4'-dihydroxydiphenylsulfonae |
| D-8: | 4-hydroxy-4'-isopropoxydiphenylsulfone |
| 4,4'-BPS: | 4,4'-dihydroxydiphenylsulfone |
| DPS: | diphenylsulfone |

Evaluation on thermally sensitive recordability (Color Development Sensitivity)

The produced thermally sensitive recording medium was subjected to printing at an applied energy of 0.34 mJ/dot by using TH-PMD (manufactured by Okura Denki). Image densities of a background portion and a printed portion were measured by using a Macbeth Densitometer (using an amber filter). In the results, the optical density is represented as a ratio of the image densities of the printed portion and background portion, that is "printed portion/background portion".

(Thermal Resistance Test)

The produced thermally sensitive recording was subjected to printing at an applied energy of 0.34 mJ/dot by using TH-PMD (manufactured by Okura Denki). The sample was left standing at 60° C. for 24 hours, and then Macbeth densities (using an amber filter) of the printed portion and the background portion were measured.

(Fade Test)

The produced thermally sensitive recording medium was subjected to printing at an applied energy of 0.34 mJ/dot by using TH-PMD (manufactured by Okura Denki). The sample was subjected to treatment at an output of 66 $W/m^2$ for 24 hours by using Ci3000F-type Xenon Fade-Ometer (manufactured by ATLAS Material Testing Technology LLC). After the treatment, the Macbeth density (using an amber filter) of the printed portion was measured.

(Plasticizer Resistance Test)

Polyvinyl chloride wrap (Hiwrap KMA, available from Mitsui Toatsu Chemicals, Inc.) was wrapped around a paper tube once. A sample piece obtained by printing at an applied energy of 0.34 mJ/dot by using TH-PMD (manufactured by Okura Denki) was attached thereon. Then, the polyvinyl chloride wrap was wrapped therearound three times and left standing at 23° C. for 2 hours. The Macbeth densities (using an amber filter) of the printed portion and the background portion were measured.

TABLE 1

| | Color developing agent | Sensitizer | Stabilizer | Dye | Color development sensitivity | Thermal resistance | Light resistance | Plasticizer resistance |
|---|---|---|---|---|---|---|---|---|
| Example 1 | D-100 | HS-3519 | | ODB-2 | 1.45/0.06 | 1.33/0.08 | 1.21 | 0.72/0.06 |
| Example 2 | D-100 | HS-3519 | SU-727 | ODB-2 | 1.37/0.07 | 1.29/0.10 | 1.13 | 1.29/0.08 |
| Example 3 | D-100 | HS-3519 | UU | ODB-2 | 1.39/0.06 | 1.25/0.12 | 1.05 | 1.17/0.13 |
| Example 4 | D-100 | HS-3519 | NTZ-95 | ODB-2 | 1.32/0.07 | 1.22/0.10 | 1.17 | 1.32/010 |
| Example 5 | D-100 | HS-3519 | D-90 | ODB-2 | 1.32/0.07 | 1.19/0.10 | 1.01 | 1.20/0.11 |
| Example 6 | D-100 | HS-3519 | NER-064 | ODB-2 | 1.37/0.07 | 1.25/0.12 | 1.12 | 1.10/0.09 |
| Example 7 | D-100 | HS-3519 | | ETAC | 1.23/0.06 | 1.19/0.10 | 1.22 | 0.68/0.07 |
| Example 8 | D-100 | HS-3519 | | ODB-7 | 1.38/0.06 | 1.24/0.13 | 1.02 | 1.15/0.08 |
| Example 9 | D-100 | HS-3520 | | ODB-2 | 1.50/0.07 | 1.42/0.22 | 1.29 | 0.83/0.07 |
| Example 10 | D-100 | HS-2046 | | ODB-2 | 1.47/0.07 | 1.36/0.20 | 1.18 | 0.79/0.07 |
| Comparative Example 1 | 2,4'-BPS | Strearamide | | ODB-2 | 1.25/0.06 | 1.19/0.73 | 0.43 | 0.24/0.08 |
| Comparative Example 2 | D-8 | DPS | | ODB-2 | 1.43/0.07 | 1.23/1.08 | 0.38 | 0.36/0.09 |
| Comparative Example 3 | D-100 | Strearamide | | ODB-2 | 1.21/0.08 | 1.15/0.58 | 0.54 | 0.27/0.09 |
| Comparative Example 4 | 4,4'-BPS | HS-3519 | | ODB-2 | 0.97/0.07 | 0.89/0.10 | 0.23 | 0.43/0.10 |

Example 11

Production of Base Paper

To 50 parts of pulp slurry formed of hardwood bleached craft pulp (freeness of 350 ml C.S.F) and 50 parts of pulp slurry formed of recycled pulp (freeness of 350 ml C.S.F), 0.16 part of a neutral rosin sizing agent, 0.3 part of aluminum sulfate, 0.7 part of cationic starch, 13 parts of calcium carbonate and 6.5 parts of kaolin as fillers, and 0.015 part of a retention aid were added. The mixture was made into paper and dried using a twin wire paper machine, to thereby produce base paper having a basic weight of 80 g/m$^2$.

(Production of Thermally Sensitive Recording Layer)

A coating liquid for a thermally sensitive recording layer was obtained in exactly the same manner as in Example 1. The coating liquid was coated and dried on a surface of a base paper having a basic weight of 80 g/m$^2$ such that a coating amount after drying was 6 g/m2. The resultant coated paper was subjected to supercalendering treatment to a Bekk smoothness of 200 to 600 sec, to thereby obtain a thermally sensitive recording medium.

(Production of InkJet Recording Surface)

A coating liquid containing 1% of polyvinyl alcohol (PVA-117, available from Kuraray Co., Ltd.), 1% of magnesium sulfate, and 1% of a cationic resin (cationic degree of 5 meq/g, MW of 1.0×10$^5$, polyamide epichlorohydrin resin) in solid content was coated and dried on the opposite surface of the base paper such that the coating amount was 2.25 g/m$^2$ as dried content. The resultant coated paper was subjected to machine calendering finishing, to thereby obtain a thermally sensitive recording medium of Example 11. A Stockigt size of the inkjet recording surface was 0 seconds.

Comparative Example 5

A thermally sensitive recording medium of Comparative Example 5 was obtained in the same manner as in Example 9 except that D-100 (trade name, available from Nippon Soda Co., Ltd.) in the dispersion of the color developing agent was changed to 4,4'-dihydroxydiphenylsulfone (4,4'-BPS) in the thermally sensitive recording layer of Example 11 and that nothing was coated on the surface opposite to the surface provided with the thermally sensitive recording layer.

Example 12

The same coating liquid for a thermally sensitive recording layer as that of Example 9 was coated and dried on a surface of a base paper having a basic weight of 80 g/m$^2$ produced in the same manner as in Example 11 such that a coating amount after drying was 6 g/m$^2$. The resultant coated paper was subjected to supercalendering treatment to a Bekk smoothness of 200 to 600 sec, to thereby obtain a thermally sensitive recording medium.

(Production of InkJet Recording Layer)

40 parts of synthetic amorphous silica (Finesil X-37B, available from Tokuyama Corporation) and 60 parts of synthetic amorphous silica (SYLOID 621, available from W. R. Grace & Co.) as pigments, and 25 parts of polyvinyl alcohol (PVA-117, available from Kuraray Co., Ltd.), 4 parts of an ethylene vinyl acetate emulsion (SUMIKAFLEX 7400, available from Sumitomo Chemical Co., Ltd.), and 4 parts of styrene butadiene latex (Lx438C, available from ZEON Corporation) as hydrophilic binders were mixed. Further, 2 parts of a styrene acrylic resin (Polymaron 360, available from Arakawa Chemical Industries, Ltd.) and 8 parts of a polyamine-based dye fixing agent (PAS-H-10L, available from Nitto Boseki Co., Ltd.) as surface sizing agents were added to the mixture. Dilution water was added thereto, to thereby prepare a colored coating liquid having a solid content of 20%.

The coating liquid was coated and dried on a surface of the base paper opposite to the surface coated with the thermally sensitive recording layer by using a bar blade coater such that a coating amount was 12 g/m$^2$ as dried solid content. The resultant coated paper was dried and subjected to machine calendering finishing, to thereby obtain a thermally sensitive recording medium of Example 12. A Cobb water absorption of the surface of the base paper to be provided with the inkjet recording layer was 55 g/m$^2$.

Comparative Example 6

A thermally sensitive recording medium of Comparative Example 6 was obtained in the same manner as in Example 12 except that D-100 (trade name, available from Nippon Soda Co., Ltd.) in the dispersion of color developing agent was changed to 4,4'-dihydroxydiphenylsulfone (bisphenol S: BPS) in the thermally sensitive recording layer of Example 12 and that nothing was coated on the surface opposite to the surface provided with the thermally sensitive recording layer.

Example 13

| <Base paper> | |
|---|---|
| (Composition of surface layer (inkjet recording layer surface)) | |
| Pulp: hardwood bleached kraft pulp (freeness of 360 ml C.S.F) | 50 parts |
| Filler: kaolin clay | 20 parts |
| Additive: cationic starch | 1 part |
| (Composition of back surface layer (thermally sensitive recording layer surface)) | |
| Pulp: hardwood bleached kraft pulp (freeness of 360 ml C.S.F) | 50 parts |
| Filler: | not used |
| Additive: cationic starch | 1 part |
| anionic polyacrylamide | 0.15 part |
| alkyl ketene dimer emulsified product | 0.15 part |

(Production of Base Paper)

A back surface layer web and a surface layer web having the respective compositions were formed using a wire multilayer paper machine. Two layers of webs having the surface layer web piled on the back surface layer web were dehydrated by using a wet press. The resultant laminate was subjected to two-stage density pressing and dried, to thereby produce base paper having a two-layer structure. Next, a 5% oxidized starch liquid was coated on the resulting base paper by using a size press such that a dried weight was 3.5 g/m2. The resultant coated paper was dried and subjected to machine calendering treatment, to thereby produce base paper having a basic weight of 80 g/m$^2$. The base paper had a filler content of 26% in the surface layer, and a filler content of 0.1% in the back surface.

(Production of Thermally Sensitive Recording Layer)

A coating liquid for a thermally sensitive recording layer was obtained in exactly the same manner as in Example 1.

The coating liquid was coated and dried on a low filler content surface of base paper having a basic weight of 80 g/m$^2$ such that a coating amount after drying was 6 g/m$^2$. The resultant coated paper was subjected to supercalendering treatment to a Bekk smoothness of 200 to 600 sec, to thereby obtain a thermally sensitive recording medium.

(Production of InkJet Recording Layer)

40 parts of synthetic amorphous silica (Finesil X-37B, available from Tokuyama Corporation) and 60 parts of synthetic amorphous silica (SYLOID 621, available from W. R. Grace & Co.) as pigments, and 25 parts of polyvinyl alcohol (PVA-117, available from Kuraray Co., Ltd.), 4 parts of an ethylene vinyl acetate emulsion (SUMIKAFLEX 7400, available from Sumitomo Chemical Co., Ltd.), and 4 parts of styrene butadiene latex (Lx438C, available from ZEON Corporation) as hydrophilic binders were mixed. Further, 2 parts of a styrene acrylic resin (Polymaron 360, available from Arakawa Chemical Industries, Ltd.) and 8 parts of a polyamine-based dye fixing agent (PAS-H-10L, available from Nitto Boseki Co., Ltd.) as surface sizing agents were added to the mixture. Dilution water was added thereto, to thereby prepare a colored coating liquid having a solid content of 20%.

The coating liquid was coated and dried on a high filler content surface of the base paper by using a bar blade coater such that a coating amount was 9 g/m2 as dried solid content. The resultant coated paper was subjected to finishing through machine calendering, to thereby obtain a thermally sensitive recording medium of Example 13.

Comparative Example 7

A thermally sensitive recording medium of Comparative Example 7 was obtained in the same manner as in Example 13 except that D-100 (trade name, available from Nippon Soda Co., Ltd.) in the dispersion of color developing agent was changed to 4,4'-dihydroxydiphenylsulfone (bisphenol S: BPS) in the thermally sensitive recording layer of Example 13 and that nothing was coated on the surface opposite to the surface provided with the thermally sensitive recording layer.

The thermally sensitive recording medium obtained in each of Examples 11 to 13 and Comparative Examples 5 to 7 was evaluated for performance regarding back surface inkjet recordability through the following method. Further, the color development sensitivity and light resistance of the thermally sensitive recording layer surface were evaluated through the above-described tests. Tables 2 to 4 show the results.

Evaluation on Inkjet Recordability (Stockigt Size)

The Stockigt size was measured in accordance with JIS P 8122.

(Cobb Water Absorption)

The Cobb water absorption was measured in accordance with JIS P 8140 (Paper and board-Determination of water absorptiveness-Cobb method). The method involves testing of water absorption of non-water absorbing paper or paperboard after one side thereof is brought into contact with water for a predetermined time period. In the present invention, a contact time of water and a sample piece was set at 30 sec, and an initial humidity-conditioned weight of the sample piece was subtracted from the weight of the sample after absorption, to thereby measure an absorption weight (g/m$^2$) per unit area. In the Cobb water absorption method, a higher water absorption resistance (that is, absorption resistance) indicates a smaller absorption weight, and a lower water absorption resistance indicates a larger absorption weight.

(Print Density)

Solid printing (black) was performed by using a printer (PM-4000PX, manufactured by Seiko Epson Corporation), and a print density was measured after 24 hours by using a Macbeth densitometer (RD915). An O.D. value of 1.3 or more indicates a level causing no problems in practical use.

(Feathering)

Black thin lines were printed and recorded by using a printer (PM-4000PX, manufactured by Seiko Epson Corporation), and the printed lines were visually judged. Evaluation criteria are described below. ⊙: Favorable level with little feathering and very little thickening of lines. ○: Favorable level causing no problems in practical use with slight feathering and thickening of lines. Δ: Level causing problems in practical use with feathering and thickening of lines. X: Poor level with extensive feathering and thickening of lines.

(Bleeding)

A black rectangle was recorded in a yellow solid portion by using a printer (PM-4000PX, manufactured by Seiko Epson Corporation), and the printed rectangle was visually judged. Evaluation criteria are described below. ⊙: Favorable level with little bleeding at a boundary. ○: Favorable level causing no problems in practical use with slight bleeding at a boundary. Δ: Level causing problems in practical use with bleeding at a boundary. X: Poor level with extensive bleeding at a boundary.

(Ink Water Resistance)

Letters were printed (black) by using a printer (PM-950C, manufactured by Seiko Epson Corporation) and left standing for 24 hours. Ion-exchanged distilled water was dropped onto the resultant printed paper, and bleeding of the letters was visually judged. Evaluation criteria are described below. ⊙: Favorable level with substantially no bleeding of letters. ○: Favorable level causing no problems in practical use with slight bleeding of letters. Δ: Level causing problems in practical use with bleeding of letters. X: Poor level with extensive bleeding of letters.

(Color Developing Ability)

A solid image of each of black, cyan, magenta, and yellow was printed by using a dye ink type printer (PM-950C, manufactured by Seiko Epson Corporation) and left standing for one day. The print density of each image portion was measured by using a reflectance densitometer (Machbeth RD914). A larger total density value of the four colors indicates a better color developing ability.

○: Total density value of four colors of 6.60 or more

Δ: Total density value of four colors of 6.40 or more and less than 6.60

X: Total density value of four colors of less than 6.40

(Ink Absorbing Ability)

Solid images of red and green were printed side by side, and the ink absorbing ability was evaluated by a level of bleeding at the boundary.

○: Clear boundary and no bleeding observed

Δ: Somewhat unclear boundary but no bleeding observed

X: Unclear boundary and bleeding observed

TABLE 2

| | Thermally sensitive recording layer surface | | | Back surface | | | Thermally sensitive recordability | | Inkjet recordability | | | |
|---|---|---|---|---|---|---|---|---|---|---|---|---|
| | Color developing agent | Sensitizer | Stabilizer | Cationic degree meq/g | Molecular weight | Coating amount g/m$^2$ | Color development, sensitivity | Light resistance | Print density | Feathering | Bleeding | Ink water resistance |
| Example 11 | D-100 | HS-3519 | None | 5 | $10^5$ | 2.25 | 1.35 | 1.03 | 1.4 | ⊙ | ⊙ | ⊙ |
| Comparative Example 5 | 4,4'-BPS | ↓ | None | | | None | 1.19 | 0.14 | 1.19 | X | X | X |

TABLE 3

| | Thermally sensitive recording layer surface | | | Back surface | | Thermally sensitive recordability | | Inkjet recordability | |
|---|---|---|---|---|---|---|---|---|---|
| | Color developing agent | Sensitizer | Stabilizer | Cobb water absorption g/m$^2$ | Coating amount g/m$^2$ | Color development sensitivity | Light resistance | Color developing ability | Ink absorbing ability |
| Example 12 | D-100 | HS-3519 | None | 55 | 12 | 1.35 | 1.03 | 6.89 (⊙) | ⊙ |
| Comparative Example 6 | 4,4'-BPS | ↓ | None | | None | 1.19 | 0.14 | X | X |

TABLE 4

| | Thermally sensitive recording layer surface | | | Base paper Filler of | | Back surface | | Thermally sensitive recordability | | Inkjet recordability | |
|---|---|---|---|---|---|---|---|---|---|---|---|
| | Color developing agent | Sensitizer | Stabilizer | thermally sensitive surface % | Filler of IJ surface % | Filler | Coating amount g/m$^2$ | Color development sensitivity | Light resistance | Color developing ability | Ink absorbing ability |
| Example 13 | D-100 | HS-3519 | None | 0.1 | 26 | Silica | 9 | 1.35 | 1.03 | ⊙ | ⊙ |
| Comparativ | 4,4'-BPS | ↓ | None | 0.1 | 26 | | None | 1.19 | 0.14 | X | X |

INDUSTRIAL APPLICABILITY

The thermally sensitive recording medium of the present invention has a high color development sensitivity, favorable thermal resistance in color image and background portion, and excellent image stability to light or a plasticizer, even without a protective layer. When the thermally sensitive recording medium is provided with inkjet recordability on the back surface, the inkjet recording surface has a good balance between feathering and bleeding, ink water-resistance, and excellent color developing ability and ink absorbing ability. Therefore, the thermally sensitive recording medium of the present invention is suitable for not only conventional applications of the thermally sensitive recording medium but also applications thereof as a note having much information and requiring high image stability, and is highly practical.

The invention claimed is:

1. A thermally sensitive recording medium comprising a thermally sensitive recording layer containing a colorless or pale colored basic colorless dye and an organic color developing agent as main components on a support, wherein the thermally sensitive recording medium contains;

a compound represented by the following general formula (1) as the organic color developing agent, (1)

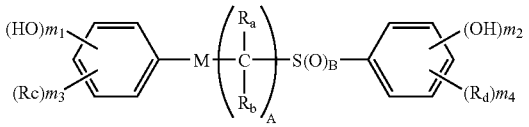

wherein, $R_a$ and $R_b$ each independently represent a hydrogen atom or an alkyl group having 1 to 6 carbon atoms, A represents an integer of 1 to 6; B represents 0, 1, or 2, $m_1$ and $m_2$ each independently represent 0 or an integer of 1 to 3, but $m_1$ and $m_2$ are not both 0, $R_c$ and $R_d$ may be different from each other; M represents CO or $NR_eCO$, wherein, $R_e$ represents a hydrogen atom or an alkyl group having 1 to 6 carbon atoms, when M is CO, $m_1$ is 1, and when $m_1$ is 0 and M is $NR_eCO$, B is not 0, and an oxalate compound represented by the following the general formula (2) as a sensitizer, (2)

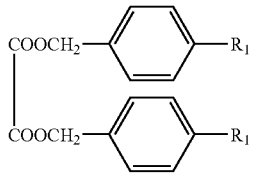

wherein, $R_1$ represents a halogen atom.

2. The thermally sensitive recording medium of claim 1, wherein the thermally sensitive recording layer further contains at least one compound selected from the group consisting of 3-{[(phenylamino)carbonyl]amino}benzene-sulfonamide represented by the following general formula (3), a urea-urethane compound represented by the following general formula (4), an epoxy group-containing diphenylsulfone compound represented by the following general formula (5), a diphenylsulfone-type oligomer compound represented by the following general formula (6), and a copolymer of glycidyl methacrylate and a vinyl monomer having an average molecular weight of 9,000 to 11,000, an epoxy equivalent of 300 to 600, and a melting point of 110° C. or lower as an image stabilizer, (3)

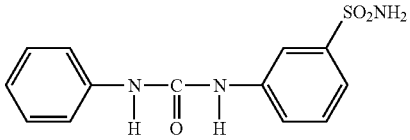

(5)

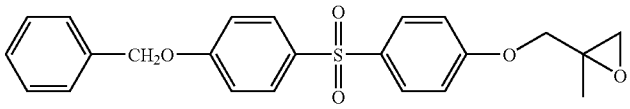

(4)

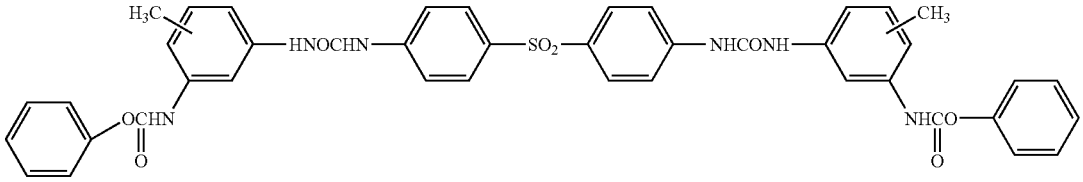

(6)

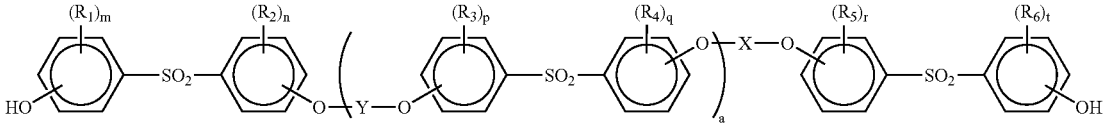

$R_d$ each independently represent a nitro group, a carboxyl group, a halogen atom, an alkyl group having 1 to 6 carbon atoms, or an alkenyl group having 2 to 6 carbon atoms, $m_3$ and $m_4$ each independently represent 0 or an integer of 1 or 2, when $m_3$ and $m_4$ are both 2, wherein, X and Y may be different from each other and each represent a hydrocarbon group having 1 to 12 carbon atoms which may be linear or branched and may have a saturated, unsaturated, or ether bond, alternatively, X and Y each may be

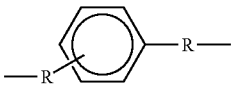

represented by the following formulae,

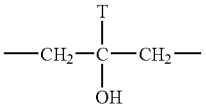

or wherein R represents a methylene group or an ethylene group and T represents a hydrogen atom or an alkyl group having 1 to 4 carbon atoms, $R_1$ to $R_6$ each independently represent a halogen atom, an alkyl group having 1 to 6 carbon atoms, or an alkenyl group, m, n, p, q, r, and t each represent an integer of 0 to 4 and when m, n, p, q, r, and t each are 2 or more, $R_1$ to $R_6$ can be different from each other, and a represents an integer of 0 to 10.

3. The thermally sensitive recording medium of claim 1, wherein the thermally sensitive recording layer contains at least one compound selected from the group consisting of 3-(N-ethyltoluidino)-6-methyl-7-anilinofluorane and 3-diethylamino-6-methyl-7-(3-methylanilino)fluorine as the basic colorless dye.

4. The thermally sensitive recording medium according to claim 1 comprising, an inkjet recording surface on a back surface which is provided with inkjet recordability by coating or impregnating a coating liquid containing a water-soluble polymer, a water-soluble inorganic salt containing metal ions of divalent or more, and a cationic resin having a cationic degree of 4 to 8 meq/g or more and a molecular weight of 100,000 or more as main materials to an opposite surface of the support on which the thermally sensitive recording layer is provided.

5. The thermally sensitive recording medium according to claim 1 comprising, an inkjet recording surface on a back surface which is provided with inkjet recordability to an opposite surface of the support on which a thermally sensitive recording layer is provided, wherein a Cobb water absorption is 30 $g/m^2$ or more.

6. The thermally sensitive recording medium according to claim 1 comprising, an inkjet recording surface on a back surface which is provided with inkjet recordability to an opposite surface of the support on which a thermally sensitive recording layer is provided, wherein the support has a multilayer structure of at least two layers, and an outermost layer of a surface opposite to the thermally sensitive recording layer comprises a layer having a high filler content satisfying ink receptivity.

* * * * *